US012163662B2

(12) United States Patent
Kroniger et al.

(10) Patent No.: US 12,163,662 B2
(45) Date of Patent: Dec. 10, 2024

(54) GAS TURBINE COMBUSTOR

(71) Applicant: KAWASAKI JUKOGYO KABUSHIKI KAISHA, Kobe (JP)

(72) Inventors: Daniel Kroniger, Kobe (JP); Atsushi Horikawa, Kobe (JP)

(73) Assignee: KAWASAKI JUKOGYO KABUSHIKI KAISHA, Kawasaki (JP)

( * ) Notice: Subject to any disclaimer, the term of this patent is extended or adjusted under 35 U.S.C. 154(b) by 0 days.

(21) Appl. No.: 18/518,811

(22) Filed: Nov. 24, 2023

(65) Prior Publication Data

US 2024/0085022 A1 Mar. 14, 2024

Related U.S. Application Data

(63) Continuation of application No. PCT/JP2022/020623, filed on May 18, 2022.

(30) Foreign Application Priority Data

May 28, 2021 (JP) ..... 2021-090376

(51) Int. Cl.
*F23R 3/28* (2006.01)

(52) U.S. Cl.
CPC ..... *F23R 3/28* (2013.01)

(58) Field of Classification Search
CPC .... F23R 3/286; F23R 3/16; F23R 3/28; F23R 3/283; F23R 3/34; F23R 3/32; F23R 3/10; F23R 3/18
See application file for complete search history.

(56) References Cited

U.S. PATENT DOCUMENTS

2004/0148937 A1* 8/2004 Mancini ..... F23R 3/343 60/740
2004/0250547 A1* 12/2004 Mancini ..... F23D 11/386 60/740
2010/0011770 A1* 1/2010 Chila ..... F23R 3/14 60/737
2017/0074521 A1* 3/2017 Horikawa ..... F23R 3/286

FOREIGN PATENT DOCUMENTS

JP 2010-025541 A 2/2010
JP 2012-013007 A 1/2012
WO 2015/182154 A1 12/2015
WO 2015/182727 A1 12/2015

* cited by examiner

*Primary Examiner* — Craig Kim
(74) *Attorney, Agent, or Firm* — Oliff PLC

(57) ABSTRACT

A gas turbine combustor includes a fuel injection device provided to a combustion tube forming a combustion chamber on an inner side, and including: a fuel injection portion having a plurality of fuel injection holes which inject fuel in directions containing components perpendicular to an axial direction and a common fuel supply chamber which supplies fuel into the plurality of fuel injection holes; and an air guide portion which guides air to fuel injected from each fuel injection hole. The fuel injection portion has an air guide surface which guides air for combustion and is located frontward in the axial direction of the combustion chamber relative to the fuel injection hole. A fuel injection opening of the fuel injection hole is provided at a bottom wall surface of a stepped recess recessed in a step shape from the air guide surface.

6 Claims, 8 Drawing Sheets

GAS TURBINE COMBUSTOR

CROSS REFERENCE TO THE RELATED APPLICATION

This application is a continuation application, under 35 U.S.C. § 111(a) of international patent application No. PCT/JP2022/020623, filed May 18 2022, which claims priority to Japanese patent application No. 2021-090376, filed May 28, 2021, the entire disclosures of all of which are herein incorporated by reference as a part of this application.

BACKGROUND OF THE INVENTION

Field of the Invention

The present invention relates to a combustor used in a gas turbine engine.

Description of Related Art

In recent years, for achieving a so-called low-carbon society, a gas turbine engine using hydrogen as fuel has been proposed. As a matter of course, fuel having a high combustion speed like fuel containing hydrogen reaches a high combustion temperature and thus readily generates NOx. In addition, in a case of combusting fuel having a high combustion speed, a backfire phenomenon in which a flame generated in a combustion chamber moves back to the burner side is likely to occur.

Accordingly, as a combustor for achieving low-NOx combustion and backfire prevention while using high-reactivity gas such as hydrogen as fuel, proposed is a combustor that uses a fuel injection device configured such that a plurality of annular members for injecting fuel are arranged concentrically, the fuel is injected in a dispersed manner in radial directions from multiple fuel injection holes provided in each annular member, and air flows toward the combustion chamber side in a direction substantially perpendicular to the fuel injected from each fuel injection hole (see, for example, Patent Document 1). With the combustor having such a structure, occurrence of local high-temperature combustion is suppressed by multipoint dispersed injection of the fuel, whereby low-NOx combustion is achieved. Further, to the injected fuel, air is supplied toward the combustion chamber side, whereby occurrence of a backfire phenomenon is suppressed.

RELATED DOCUMENT

Patent Document

[Patent Document 1] WO2015/182154

SUMMARY OF THE INVENTION

However, in the combustor disclosed in Patent Document 1, the diameter of each fuel injection hole is small, and therefore, in a case of using fuel (e.g., mixture fuel of hydrogen gas and natural gas) whose reactivity is not as high as that of pure hydrogen gas, it is difficult to stably maintain a flame.

Accordingly, in order to solve the above problem, an object of the present invention is to make it possible to stably maintain a flame even in a case of using fuel having comparatively low reactivity in a combustor of a multipoint injection type that can achieve low-NOx combustion and backfire prevention.

To attain the above object, a gas turbine combustor according to the present invention includes: a combustion tube forming a combustion chamber on an inner side; and a fuel injection device provided at a top portion of the combustion tube and configured to inject fuel into the combustion chamber. The fuel injection device includes a fuel injection portion having a plurality of fuel injection holes each configured to inject the fuel in a direction containing a component perpendicular to an axial direction of the combustion chamber, and a common fuel supply chamber configured to supply the fuel into the plurality of fuel injection holes, and an air guide portion having an air guide groove configured to guide air for combustion to the fuel injected from each fuel injection hole. The fuel injection portion has an air guide surface configured to guide the air for combustion and located frontward in the axial direction of the combustion chamber relative to the fuel injection hole. A fuel injection opening of the fuel injection hole is provided at a bottom wall surface of a stepped recess recessed in a step shape from the air guide surface.

With this configuration, the stepped recess is provided to the fuel injection portion and the fuel injection opening of the fuel injection hole is formed at the bottom wall surface of the stepped recess, whereby it becomes possible to stably maintain a flame even in a case of using fuel having low reactivity, as described in detail later.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

The present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

Hereinafter, embodiments according to the present invention will be described with reference to the drawings, although the present invention is not limited to the embodiments.

Figure 1:
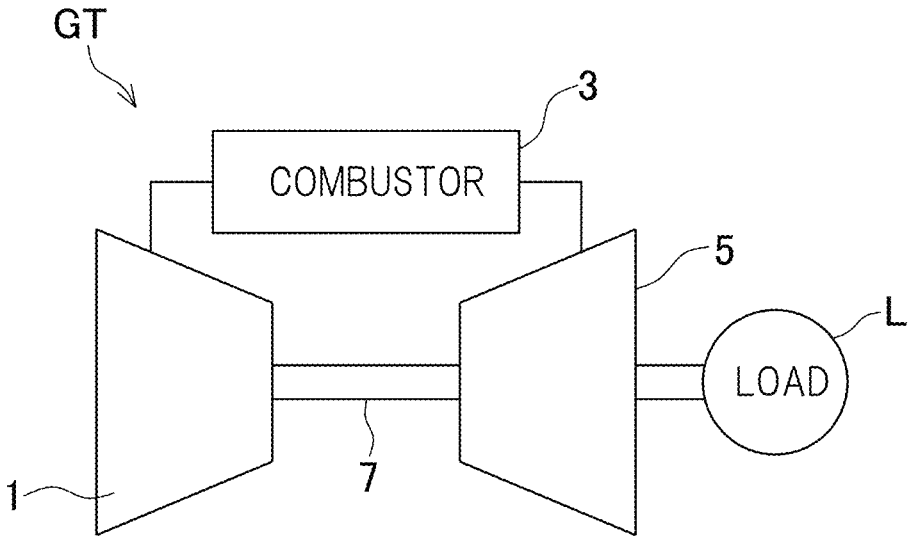
FIG. 1 is a block diagram showing a schematic configuration of a gas turbine engine to which a combustor according to an embodiment of the present invention is applied.

FIG. 1 shows a schematic configuration of a gas turbine engine (hereinafter, simply referred to as gas turbine) GT to which a combustor according to an embodiment of the present invention is applied. The gas turbine GT is configured such that introduced air is compressed by a compressor 1 and led to a combustor 3, fuel is injected into the combustor 3 and combusted, and a turbine 5 is driven by obtained high-temperature and high-pressure combustion gas G. The turbine 5 is connected to the compressor 1 via a rotary shaft 7, and the compressor 1 is driven by the turbine 5. By the output of the gas turbine GT, a load L such as a rotor of an aircraft or an electric generator is driven. The combustor 3 is a combustor of a can type in which a plurality of combustor cans are annularly arranged around the axis of the gas turbine GT, for example. The type of the combustor 3 is not limited to the can type, and may be an annular type, for example.

Figure 2:
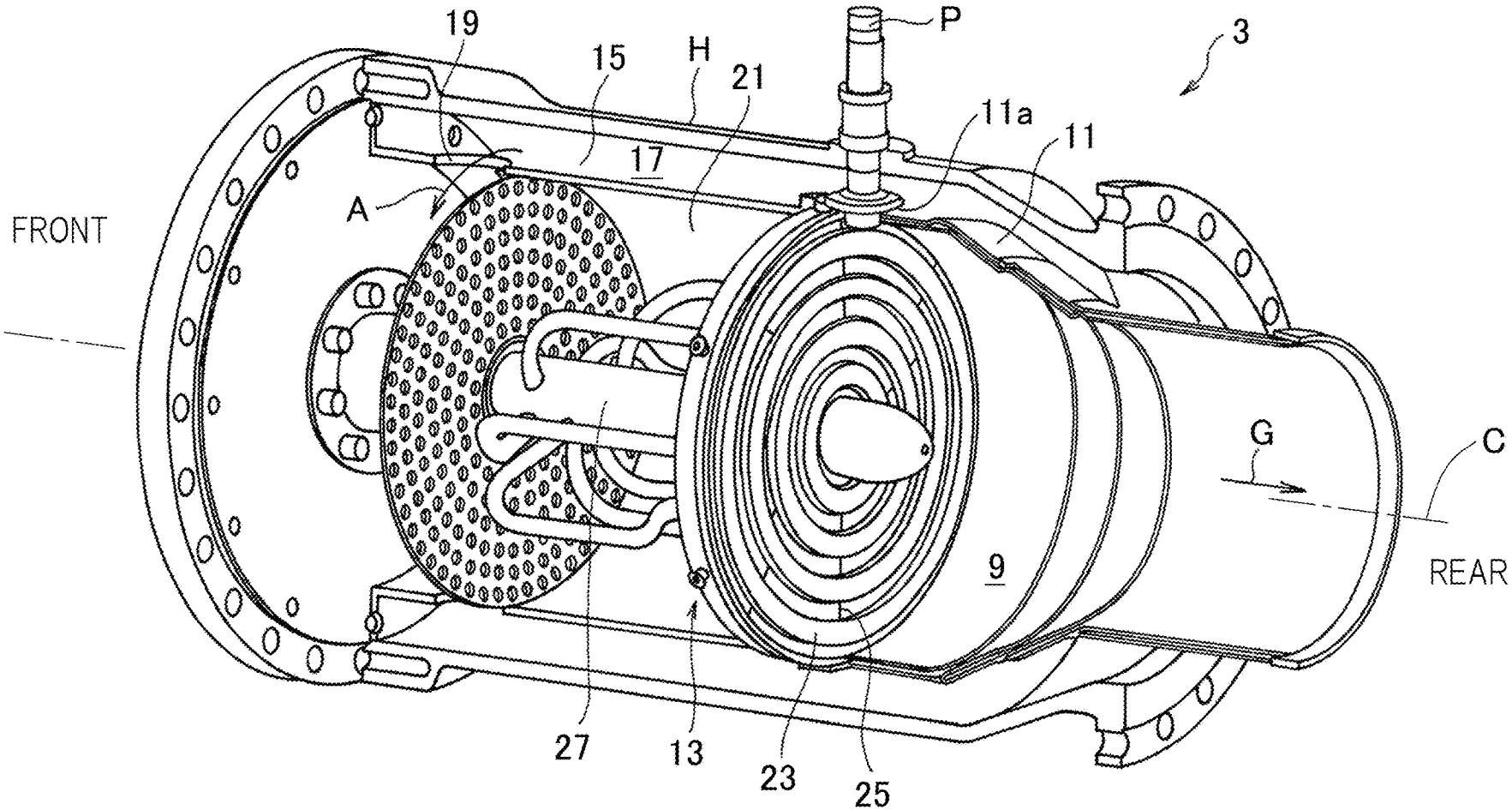
FIG. 2 is a partially cutaway perspective view showing the combustor according to the embodiment of the present invention.

As shown in FIG. 2, the combustor 3 includes a combustion tube 11 forming a combustion chamber 9 on the inner side, and a fuel injection device 13 which is attached to a top portion (most-upstream portion) 13*a* of the combustion tube 11 and injects fuel and air into the combustion chamber 9. The fuel injected from the fuel injection device 13 is ignited by an igniter P provided to the combustion tube 11, whereby a flame is formed in the combustion chamber 9. The combustion tube 11 and the fuel injection device 13 are stored concentrically in a substantially cylindrical housing H serving as an outer tube of the combustor 3. Here, as shown in FIG. 2, in the combustor 3, the combustion chamber 9 side along an axial direction C of the combustion chamber 9 is referred to as "rear side", and the opposite side is referred to as "front side". In the following description, the axial direction C of the combustion chamber 9 is simply referred to as "axial direction C".

In the present embodiment, the combustor 3 is configured as a reverse-flow type in which the flowing directions of air A and the combustion gas G are opposite to each other. That is, the combustor 3 has an air introduction passage 17 formed between the housing H, and the combustion tube 11 and a support tube 15 extending in a tubular shape frontward from the combustion tube 11. Through the air introduction passage 17, the air A compressed by the compressor 1 (FIG. 1) is led in the direction opposite to the flowing direction of the combustion gas G in the combustion chamber 9. The combustor 3 may be an axial-flow type in which the flowing directions of the air A and the combustion gas G are the same. At a front end portion of a peripheral wall of the support tube 15, a plurality of air introduction holes 19 are provided so as to be arranged in the circumferential direction. The air A sent through the air introduction passage 17 passes the air introduction holes 19, to be introduced into an air supply passage 21 formed inside the support tube 15, and then the air A is sent toward the fuel injection device 13 on the rear side.

Figure 3:
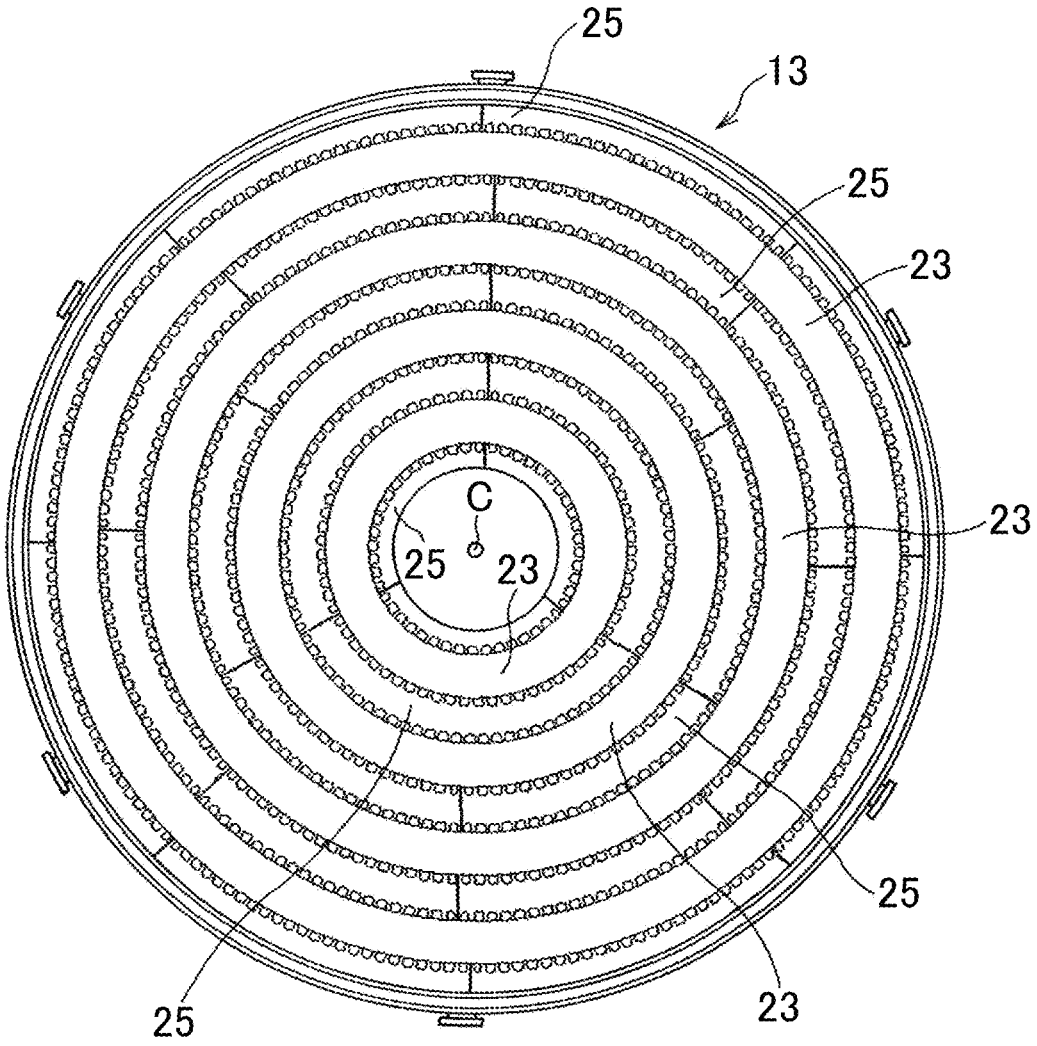
FIG. 3 is a front view showing an example of a fuel injection device used in the combustor in FIG. 2.

As shown in FIG. 3, the fuel injection device 13 includes a fuel injection portion 23 and an air guide portion 25. In the present embodiment, the fuel injection portion 23 and the air guide portion 25 are each formed in an annular shape. In this example, a plurality of (in the shown example, four) fuel injection portions 23 having different diameter sizes are arranged concentrically with each other and concentrically with the combustor 3 (FIG. 2), and annular air guide portions 25 corresponding to the shapes of the respective fuel injectors are arranged on the inner circumferential side and the outer circumferential side of each fuel injection portion 23. The fuel is supplied to each fuel injection portion 23 of the fuel injection device 13 via a fuel supply passage 27 (FIG. 2).

Figure 4:
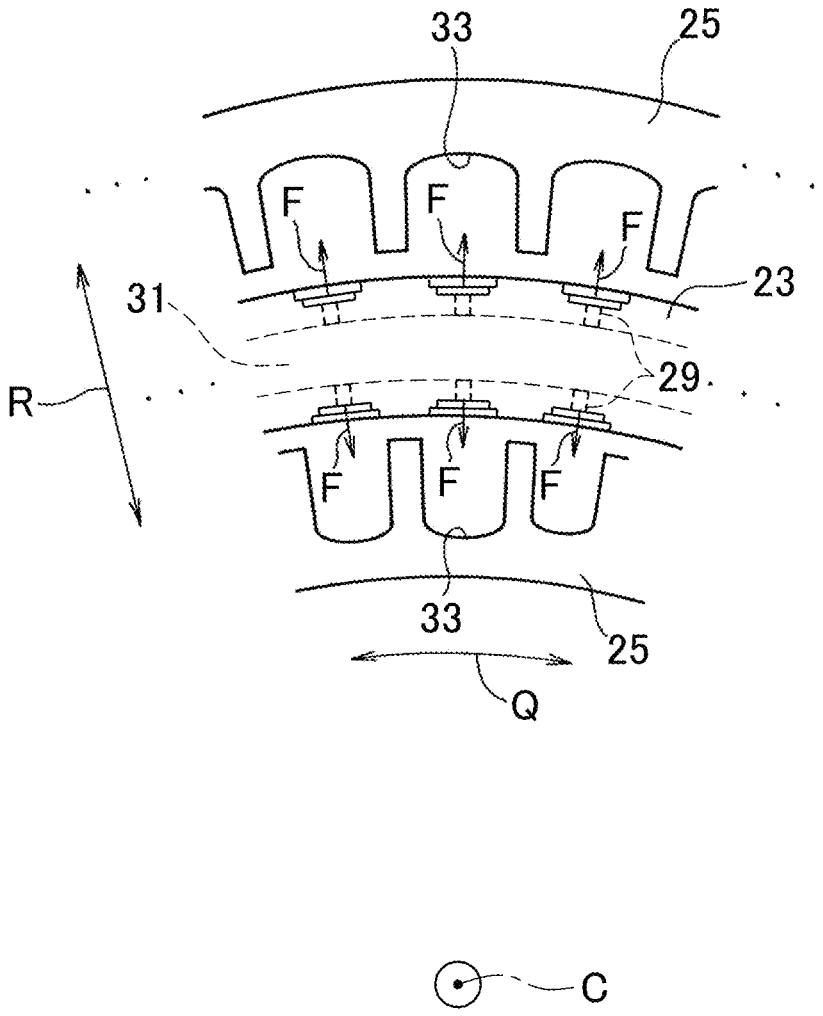
FIG. 4 is a partially enlarged front view showing the fuel injection device in FIG. 3.

As shown in FIG. 4, the fuel injection portion 23 has a plurality of fuel injection holes 29 for injecting fuel, and a common fuel supply chamber 31 for supplying the fuel F to the plurality of fuel injection holes 29.

Figure 5:
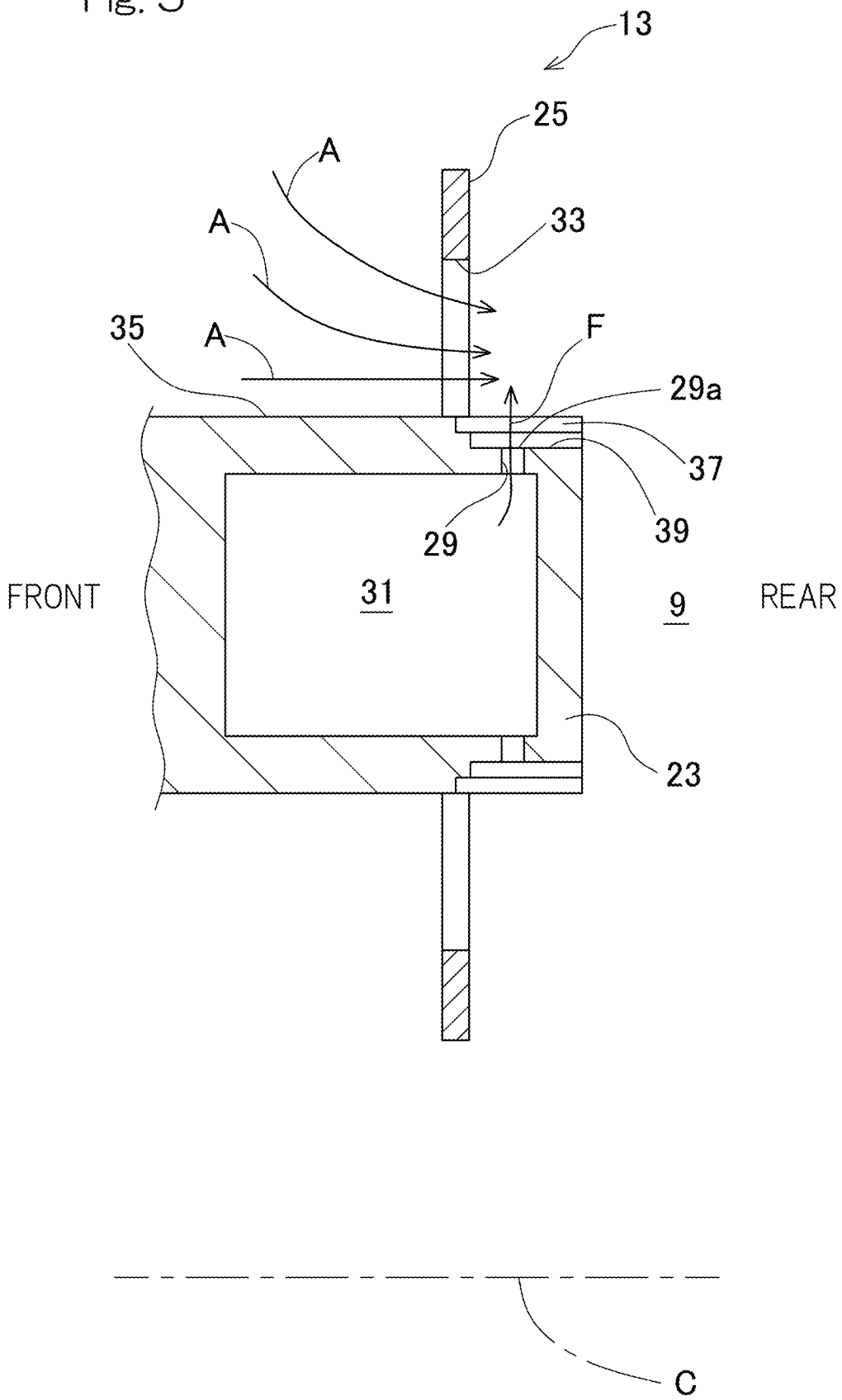
FIG. 5 is a partially enlarged vertical sectional view showing the fuel injection device in FIG. 3.
Figure 6:
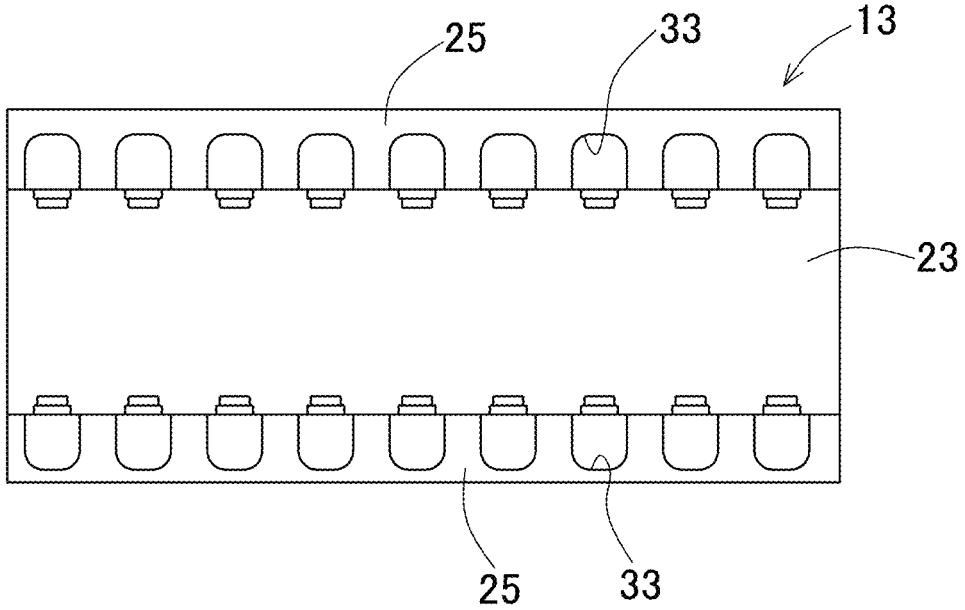
FIG. 6 is a front view showing another example of the fuel injection device used in the combustor in FIG. 2.

In the present embodiment, in each fuel injection portion 23, a large number of fuel injection holes 29 are arranged at equal intervals in the circumferential direction. Each fuel injection hole 29 is formed so as to inject fuel in a direction containing a component perpendicular to the axial direction C. Specifically, in this example, as shown in FIG. 5, each fuel injection hole 29 is formed so as to inject the fuel F in a direction (in this example, a radial direction R of the annular fuel injection portion 23) perpendicular to the axial direction C. More specifically, in this example, a vertical cross-section of the fuel injection portion 23 has a rectangular shape in the entirety, and the fuel injection holes 29 are formed as holes that open at a wall surface facing outward in the radial direction R of the fuel injection portion 23 and/or a wall surface facing inward in the radial direction R.

As shown in FIG. 4, the air guide portion 25 has air guide grooves 33 which guide the air A for combustion to the respective fuel injection holes 29. Specifically, in this example, as shown in FIG. 5, the air guide portion 25 is formed as a plate-shaped member in a direction parallel to a plane perpendicular to the axial direction C and is located on the front side relative to the fuel injection hole 29 of the fuel injection portion 23 (i.e., on the upstream side in the flowing direction of the air A). The air guide portion 25 provided as described above is partially cut out in an area on the fuel injection portion 23 side as shown in FIG. 4, whereby the air guide grooves 33 are formed. In the present embodiment, one air guide groove 33 is provided per one fuel injection hole 29.

In the fuel injection device 13 configured as described above, the fuel F injected from each fuel injection hole 29 of the fuel injection portion 23 is premixed with the air A guided by the air guide groove 33 of the air guide portion and then is injected as premixed gas into the combustion chamber 9. In this way, by the air guide portion 25, the air A from the upstream side is guided in the axial direction C to the fuel F injected from each fuel injection hole 29, whereby the fuel F and the air A cross in directions substantially perpendicular to each other. Thus, the fuel F and the air A can be uniformly mixed outside the fuel injection device 13.

The injection direction of the fuel F from the fuel injection hole 29 of the fuel injection portion 23 may be any direction that contains a component perpendicular to the axial direction C, and may be tilted in the axial direction C within a range of ±10° relative to the direction perpendicular to the axial direction C, for example.

The entire configuration of the fuel injection device 13 is not limited to the above example. For example, the shape of the fuel injection portion 23 is not limited to the annular shape shown in FIG. 3, and may be a rectangular shape in a front view (as seen in the axial direction C of the combustion chamber 9), as in a modification shown in FIG.

6. It is not necessary to provide a plurality of the fuel injection portions 23 and a plurality of the air guide portions 25 corresponding thereto, and one fuel injection portion 23 and one air guide portion may be provided.

Next, a structure around the fuel injection hole 29 of the fuel injection portion 23 will be described in detail.

As shown in FIG. 5, in the present embodiment, the fuel injection portion 23 has an air guide surface 35 which guides the air A, on the front side relative to the fuel injection hole 29. The air guide surface 35 is formed as a flat surface extending in parallel to the axial direction C. On the rear side of the air guide surface 35, a stepped recess 37 recessed in a step shape from the air guide surface 35 is formed. In this example, the stepped recess 37 extends to the rear end of the fuel injection portion 23. At a bottom wall surface 39 of the stepped recess 37, a fuel injection opening 29*a* of the fuel injection hole 29 is formed. In the following description, for convenience sake, a direction toward the bottom wall side of the stepped recess 37 may be referred to as "downward direction", and a direction toward the air guide surface 35 side may be referred to as "upward direction".

It has been confirmed that, by forming the fuel injection opening 29*a* of the fuel injection hole 29 at the bottom wall surface 39 of the stepped recess 37, it becomes possible to stably maintain a flame even in a case of using fuel F having low reactivity, as described later. This is considered to be owing to the following effects.

(1) By the side walls of the stepped recess 37, flow of the fuel F injected from the fuel injection hole 29 is assuredly directed toward the upward-rearward side where the air A flows.

(2) Flow of the air A that has flowed along the smooth air guide surface 35 is disturbed by the stepped recess 37, to form a vortex, whereby mixing with the fuel F is promoted.

(3) Owing to the presence of the stepped recess 37, the fuel F injected from the fuel injection hole 29 is protected from strong flow of the air A.

Figure 7:
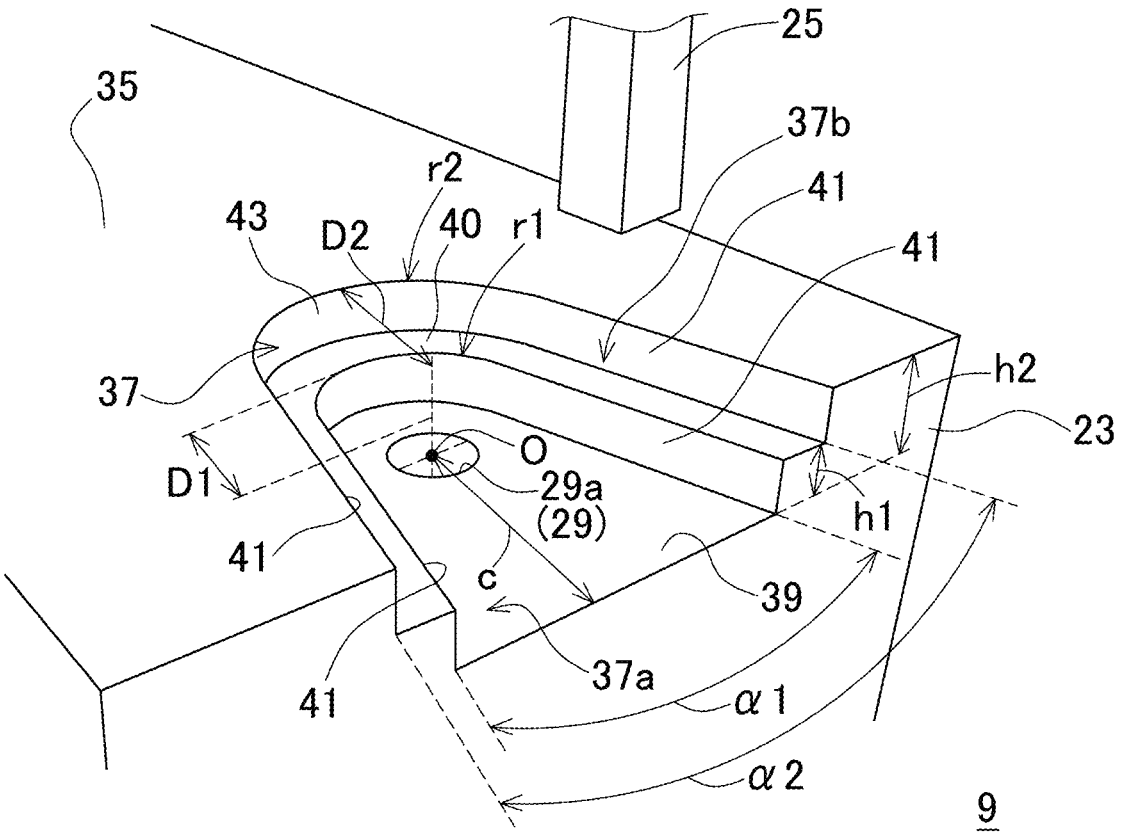
FIG. 7 is a partially enlarged perspective view showing the fuel injection device in FIG. 3.

In this example, as shown in FIG. 7, the stepped recess 37 is formed in a shape recessed with a plurality of stages (in this example, two stages), and has the bottom wall surface 39 at the lowermost stage and a bottom wall surface 40 at the first stage. In the present embodiment, the fuel injection opening 29*a* of the fuel injection hole 29 is formed at the bottom wall surface 39 at the lowermost stage. In a case where the stepped recess 37 has a one-stage structure, the fuel injection opening 29*a* of the fuel injection hole 29 is formed at the bottom wall surface 40 at the first stage. In the following description, for convenience sake, the lowermost stage part of the stepped recess 37 may be referred to as first step portion 37*a*, and a second stage part may be referred to as second step portion 37*b*.

Figure 8:
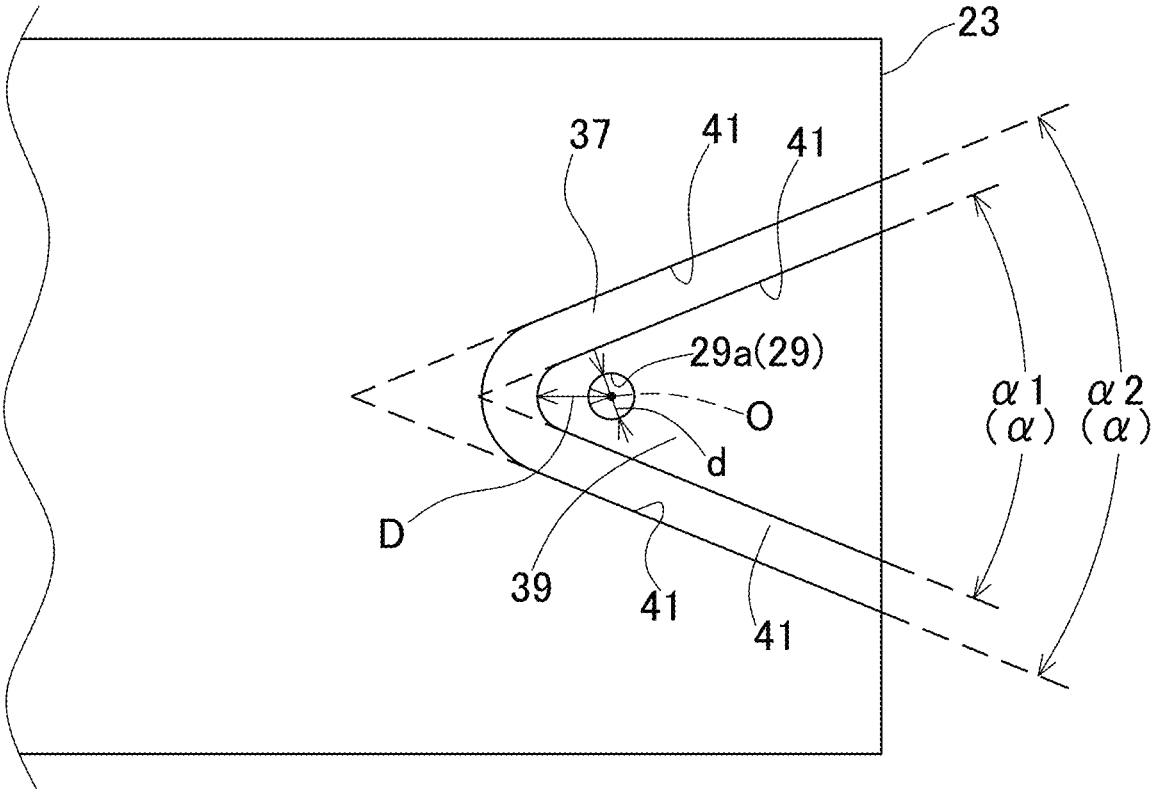
FIG. 8 is a partially enlarged plan view showing the fuel injection device in FIG. 3.

In the present embodiment, both side walls 41 of the stepped recess 37 are formed in such a shape that the interval between both side walls 41 gradually expands from the front end of the stepped recess 37 toward the rear end thereof (i.e., toward the combustion chamber 9 side). More specifically, as shown in FIG. 8, both side walls 41 of the stepped recess 37 extend so as to form parts of two equal-length sides of a virtual isosceles triangle whose bottom side is the rear end of the fuel injection portion in a plan view. In the shown example, a front end portion 43 of the stepped recess 37, corresponding to the apex of the virtual isosceles triangle, is formed in a curved shape recessed frontward.

By forming both side walls 41 of the stepped recess 37 in such a shape that the interval between both side walls 41 gradually expands from the front end toward the rear end as described above, the flow speed of mixture gas flow of the air A and the fuel F injected from the fuel injection hole 29 gradually decreases through expansion of the flow path as the mixture gas moves toward the combustion chamber 9 side. Similarly, by forming the stepped recess 37 in a shape recessed with a plurality of stages, the flow speed of flow of the fuel F injected from the fuel injection hole 29 gradually decreases through expansion of the flow path as the fuel F moves upward. Thus, mixing of the fuel F and the air A is further promoted.

In a plan view, the range of an angle $\alpha$ formed by both side walls 41 is preferably $0° < \alpha \leq 80°$, more preferably $20° \leq \alpha \leq 60°$, and even more preferably $25° \leq \alpha \leq 40°$. In the shown example, angles $\alpha 1$, $\alpha 2$ between the side walls 41 at the respective stages in the multistage stepped recess 37 are the same a, but in the case where the stepped recess 37 has a plurality of stages, the angles between the side walls 41 at the respective stages may be different from each other.

It is not necessary to form both side walls 41 of the stepped recess 37 in such a shape that the interval between both side walls 41 gradually expands from the front end toward the rear end as described above, and a may be 0° or may be a negative angle (such an angle that the interval between both side walls 41 gradually narrows from the front end toward the rear end). In a plan view, the shapes of the both side walls 41 need not be straight shapes as shown in the drawings, and may be curved, for example.

It is not necessary that the stepped recess 37 has a plurality of stages, and the stepped recess 37 may have only one stage. In a case where the stepped recess 37 has a plurality of stages, the number of stages is not limited to two as shown in the drawings, and may be three or more.

The position of the fuel injection opening 29*a* of the fuel injection hole 29 in the bottom wall surface 39 at the lowermost stage of the stepped recess 37 is not particularly limited. However, as described later, it has been confirmed that a flame can be more stably maintained when a distance D between a center point O of the fuel injection opening 29*a* of the fuel injection hole 29 and the front end point at the lowermost stage of the stepped recess 37 is shorter. The reason is considered that the effects (1) to (3) by the stepped recess 37 as described above are obtained more significantly when the fuel injection hole 29 is close to the rear end wall of the stepped recess 37. Therefore, where the hole diameter of the fuel injection hole 29 is denoted by d, the range of the distance D is preferably $D \leq 2d$, and may be $D \leq d$ or may be $D = d/2$ (i.e., the front end of the fuel injection hole 29 coincides with the front end point at the lowermost stage of the stepped recess 37).

The position of the stepped recess 37 relative to the air guide portion is not particularly limited. However, the flow speed of the air A for combustion is greatest near the air guide groove 33 of the air guide portion 25, and therefore the fuel F is preferably injected near the air guide groove 33. In addition, from the standpoint for backfire prevention, entry of the fuel F into the air A is preferably performed on the downstream side of the air guide portion 25. From this standpoint, the front end of the stepped recess 37 is preferably located rearward relative to the front end of the air guide portion 25. Further, the front end of the stepped recess 37 is preferably located within the range of the thickness (the dimension in the axial direction C) of the air guide portion 25, and the front end of the stepped recess 37 more preferably coincides with the center position of the thickness of the air guide portion 25. In addition, the entirety of the stepped recess 37 is preferably included within the width-direction range of the air guide groove 33.

Specific dimensions of each part of the stepped recess 37 are selected as appropriate in accordance with the specifications such as the output, the size, and fuel F to be used, required for the combustor 3. For example, the hole diameter d of the fuel injection hole 29 may be approximately 0.5 mm to 1.0 mm in the case of the fuel injection hole 29 for multipoint injection as described above. In this case, the dimension in the axial direction C and the dimension in the width direction of the stepped recess 37 may be approximately several mm.

Various dimensions other than those described above in the fuel injection device according to the present embodiment shown in FIG. 7 may be set as appropriate, and as an example, may be set in the following ranges. However, these dimensions are not limited to the following ranges.

A distance c from the center point O of the fuel injection opening 29*a* of the fuel injection hole 29 to the rear end of the bottom wall surface 39 of the first step portion 37*a* may be not less than 1.5 mm and not greater than 4.0 mm. A height h1 of the first step portion 37*a* may be not less than 0.1 mm and not greater than 1.5 mm, and a height h2 of the second step portion 37*b* may be not less than 0.2 mm and not greater than 3.0 mm. A distance D1 from the center point O of the fuel injection opening 29*a* of the fuel injection hole 29 to the front end point of the first step portion 37*a* may be not less than 0.2 mm and not greater than 1.9 mm, and a similar distance D2 for the second step portion 37*b* may be not less than 0.4 mm and not greater than 2.6 mm. A curvature radius r1 of a curved part at the front end of the first step portion 37*a* may be not less than 0.2 mm and not greater than 1.5 mm, and a similar curvature radius r2 for the second step portion 37*b* may be not less than 0.6 mm and not greater than 2.0 mm.

The effects of the combustor 3 according to the present embodiment configured as described above will be described with reference to a result of CFD combustion analysis.

In the CFD combustion analysis, a conventional fuel injection device not having the stepped recess 37 was used as Comparative example, and the fuel injection device 13 shown in FIG. 7 was used as Example. The side walls 41 of the stepped recess 37 in Example were formed in a shape ($\alpha$=30°) expanding straightly toward the rear side as shown in FIG. 8.

TABLE 1

| Specifications | Example | Comparative example |
|---|---|---|
| Number of stages of stepped recess | 2 | No stepped recess |
| Distance between fuel injection hole center and stepped recess front end (d: hole diameter) | d/2 | |

As fuels, fuel of 100% hydrogen gas (hereinafter, simply referred to as "hydrogen fuel") and mixture fuel of hydrogen gas and natural gas (the volume ratio of hydrogen gas and natural gas=60:40; hereinafter, simply referred to as "mixture fuel"), were used, and for each fuel, comparison was performed among temperatures corresponding to a rated load, a partial load, and no-load. States in which these fuels were combusted in the above devices were simulated and temperature distributions were compared, a result of which is shown in FIG. 9.

Figure 9:
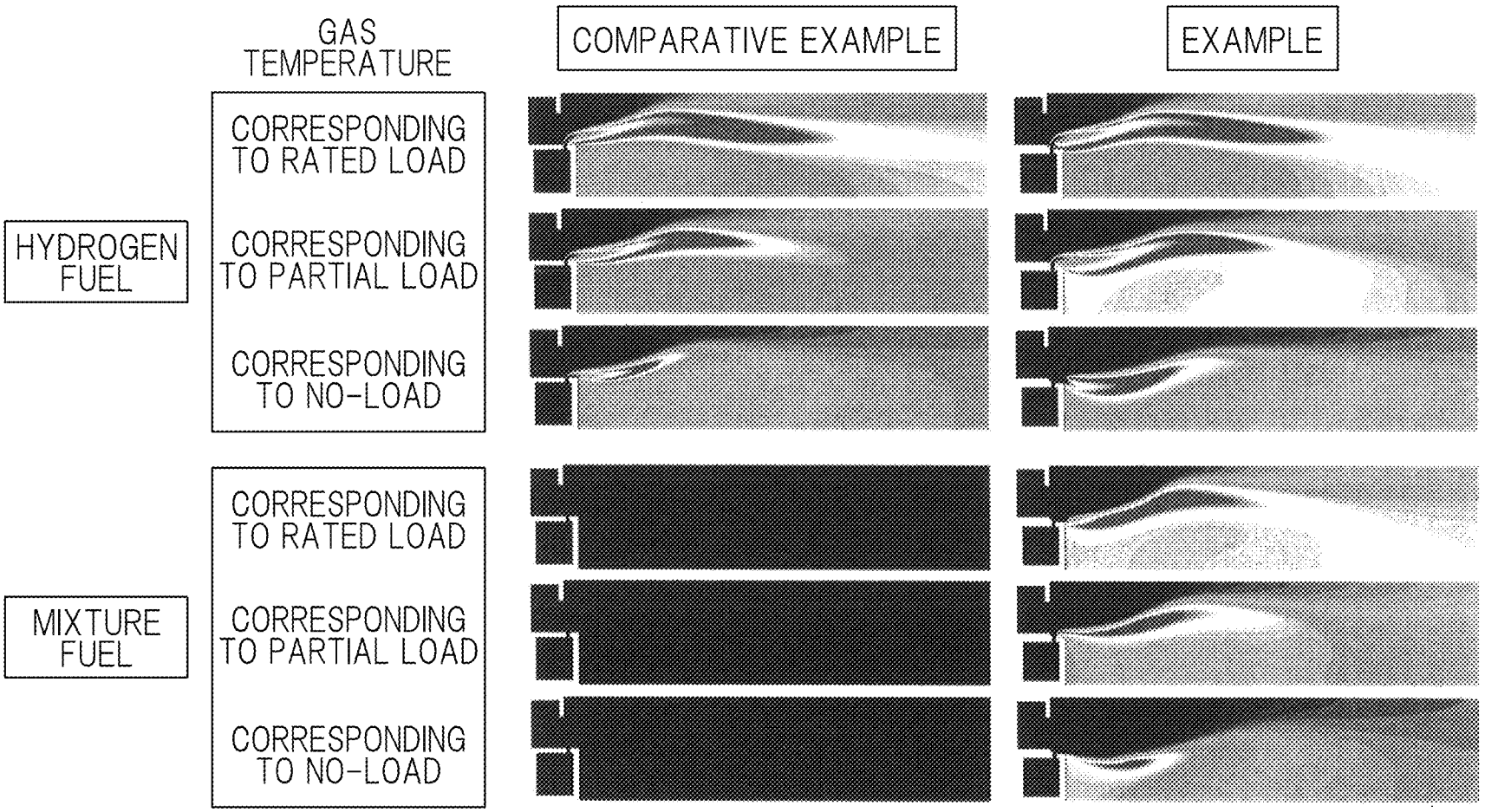
FIG. 9 shows a result of CFD combustion analysis on the fuel injection device used in the combustor in FIG. 2.

As shown in FIG. 9, in the fuel injection device according to Comparative example, in the case of hydrogen fuel, a flame could be maintained, but in the case of mixture fuel, a flame could not be maintained for any of the temperatures. On the other hand, in the fuel injection device in Example, a flame could be maintained for all the temperatures including the temperature corresponding to no-load. Thus, it has been confirmed that, by providing the stepped recess to the fuel injection portion, flame maintaining performance is significantly improved for fuel having low reactivity, and in particular, by providing the fuel injection hole at the front end of the bottom wall surface of the stepped recess, significantly favorable flame maintaining performance is exhibited.

The configuration in which the distance D between the center point O of the fuel injection opening 29*a* of the fuel injection hole 29 and the front end point at the lowermost stage of the stepped recess 37 is set as D=d/2 (i.e., the front end of the fuel injection hole 29 coincides with the front end point at the lowermost stage of the stepped recess 37) may be combined with a configuration in which the stepped recess 37 has one stage.

The kind of fuel F used in the combustor 3 according to the present embodiment is not particularly limited. However, as described above, by providing the stepped recess 37 to the fuel injection portion 23, flame maintaining performance is particularly significantly improved for fuel F having lower reactivity than hydrogen gas. Therefore, for example, by using the mixture fuel of hydrogen gas and natural gas used in the above CFD combustion analysis, it is possible to ensure stable operation while reducing fuel cost.

As described above, with the gas turbine combustor 3 according to the present embodiment, it becomes possible to stably maintain a flame even in a case of using fuel F having comparatively low reactivity in the combustor 3 of a multipoint injection type that can achieve low-NOx combustion and backfire prevention.

Although the present invention has been described above in connection with the preferred embodiments with reference to the accompanying drawings, numerous additions, modifications, or deletions can be made without departing from the gist of the present invention. Accordingly, such additions, modifications, or deletions are to be construed as included in the scope of the present invention.

REFERENCE NUMERALS

3 combustor
9 combustion chamber
11 combustion tube
13 fuel injection device
23 fuel injection portion
25 air guide portion
29 fuel injection hole
33 air guide groove
35 air guide surface
37 stepped recess
39 bottom wall surface of stepped recess
41 side wall of stepped recess
G gas turbine engine
P igniter

What is claimed is:

1. A gas turbine combustor comprising:

a combustion tube forming a combustion chamber on an inner side; and a fuel injection device provided at a top portion of the combustion tube and configured to inject fuel into the combustion chamber, the fuel injection device including a fuel injection portion having a plurality of fuel injection holes each configured to inject the fuel in a direction containing a component perpendicular to an axial direction of the combustion chamber, and a common fuel supply chamber configured to supply the fuel into the plurality of fuel injection holes, and an air guide portion having an air guide groove configured to guide air for combustion to the fuel injected from each fuel injection hole, wherein the fuel injection portion has an air guide surface configured to guide the air for combustion and located frontward in the axial direction of the combustion chamber relative to the fuel injection hole, a fuel injection opening of the fuel injection hole is provided at a bottom wall surface of a stepped recess recessed in a step shape from the air guide surface, and the stepped recess extends to a rear end of the fuel injection portion.

2. The gas turbine combustor as claimed in claim 1, wherein both side walls of the stepped recess are formed in such a shape that an interval between both side walls expands from a front end of the stepped recess toward a rear end of the stepped recess.

3. The gas turbine combustor as claimed in claim 1, wherein the stepped recess is formed in a shape recessed with a plurality of stages.

4. The gas turbine combustor as claimed in any one of claim 1, wherein a relationship between a hole diameter d of the fuel injection hole and a distance D between a center point of the fuel injection opening and a front end of a bottom wall of the stepped recess is $d/2 \leq D \leq 2d$.

5. The gas turbine combustor as claimed in claim 4, wherein the fuel injection hole is formed at such a position that a front end of the fuel injection opening coincides with the front end of the bottom wall of the stepped recess.

6. The gas turbine combustor as claimed in claim 2, wherein an angle $\alpha$ formed by both side walls is in a range of $0° < \alpha \leq 80°$.

* * * * *